US005526884A

United States Patent [19]

Lembcke

[11] Patent Number: 5,526,884

[45] Date of Patent: Jun. 18, 1996

[54] DOWNHOLE TOOL RELEASE MECHANISM

[75] Inventor: Jeffrey J. Lembcke, Houston, Tex.

[73] Assignee: Baker Hughes Incorporated, Houston, Tex.

[21] Appl. No.: 435,711

[22] Filed: May 5, 1995

[51] Int. Cl.[6] ..... E21B 23/04

[52] U.S. Cl. ..... 166/382; 166/117.6; 166/120

[58] Field of Search ..... 166/382, 120, 166/117.6, 387, 181

[56] References Cited

U.S. PATENT DOCUMENTS

| | | | |
|---|---|---|---|
| 3,603,388 | 9/1971 | Current | 166/120 |
| 4,754,814 | 7/1988 | Jordan | 166/387 |
| 4,834,185 | 5/1989 | Braddick | 166/382 |
| 5,044,441 | 9/1991 | Rubbo et al. | 166/382 |
| 5,350,013 | 9/1994 | Jani et al. | 166/217 |
| 5,360,069 | 11/1994 | Schmuck et al. . | |
| 5,411,082 | 5/1995 | Kennedy | 166/181 |

OTHER PUBLICATIONS

Baker Oil Tools, "Standard Products Technical Manual," Unit No. 8268 (Apr. 1989) (2 pages).

Baker Oil Tools, Model FH, "Retrievable Packer Systems," (p. 29) no date.

*Primary Examiner*—Frank S. Tsay

*Attorney, Agent, or Firm*—Rosenblatt & Redano

[57] ABSTRACT

A system for releasing a downhole tool such as a packer is revealed which allows the tool to retain its set position against a very high loading force which can occur during operations such as perforating or acidizing or other formation treatments. Subsequently, before environmental conditions can adversely affect the integrity of the locking mechanism which employs a movable sleeve or equivalent, the release mechanism involving such a sleeve or equivalent is actuated. This disables one of the locking mechanisms on the tool and enables a shear-release mechanism, which is preferably set at a fairly low shear force to facilitate simple removal of the downhole tool at a later time when it becomes necessary to retrieve it.

20 Claims, 6 Drawing Sheets

DOWNHOLE TOOL RELEASE MECHANISM

FIELD OF THE INVENTION

The field of this invention relates to release mechanisms for downhole tools, particularly packers or anchors, and more particularly, those which have a selectively operable shear-release mechanism.

BACKGROUND OF THE INVENTION

In the past, packers and other downhole tools have been provided with emergency-release mechanisms to facilitate retrieval of the downhole tool when conditions made that operation necessary. Baker Hughes Incorporated, through its Baker Oil Tools division, has offered shear-release packers with the shearing mechanism rated in the order of about 20,000–30,000 lbs. Other types of tools have been provided that use a sliding sleeve mechanism or collet ring to effectuate the release. In these types of designs, the release mechanism is functional when a sleeve is shifted by shifting tools of known design to undermine a collet, thereby allowing the packer or anchor to be retrieved. One type of device that uses this type of a sliding sleeve mechanism for locking and unlocking a downhole tool in position is a Baker Oil Tools Model SW, Wireline-locked, Parallel Snap Latch Seal Nipple, Product No. 707-60.

The prior designs, employing solely a shear-release mechanism, did not present a design that was suitable for wells where stimulation or acidizing were to occur. Similarly, if tubing-conveyed perforating guns were to be used, shear releases were not desirable. The reason for this was the potentiality of premature shear release when such activities were occurring. In shooting off tubing-conveyed perforating guns, the forces that could be generated could well exceed the typical range of shear forces designed into a release mechanism. Commonly, shear forces in the order of 50,000 lbs. could be generated in firing tubing-conveyed perforating guns, while certain stimulation procedures could generate shear forces on the shear-release mechanism as high as 90,000 lbs. The prior designs, using a shear-release mechanism, generally had the rated release force at considerably less than the forces that could be generated during perforating or formation treatment as described above. As a result, operators have elected not to use shear-release packers when performing such procedures. It was determined to be undesirable to raise the shear rating on the shear-release member to the levels of shear force anticipated during perforating or formation stimulation because raising the shear force required for release presented other problems when it came time to actually retrieve the packer. Normally, it was desirable to have as low a shear force as possible to facilitate the subsequent retrieval of the packer in normal operations. At the same time, it was also desirable to have a packer or other downhole tool that could withstand the forces generated during perforating or formation treatment.

Well operators, when needing to do perforating or stimulation or acidizing, have then moved to wireline-releasable packers in lieu of the shear-release mechanisms. This approach was serviceable as long as the well was not of the type that developed paraffin scale or where corrosion could attack the mechanism and make it difficult to trip with a wireline. In the design that employed only a shifting sleeve or ring mechanism to effectuate locking or release, the packer or other downhole tool would be locked into position while the subsequent operations would take place. The problem arose because there could be a very long period of time between when the perforation or formation treatment such as acidizing took place and when it then became necessary to remove the packer. In the interim period, the environmental conditions downhole could have worked on the shifting mechanism to the degree that it became unserviceable. Such mechanisms could so thoroughly jam or in other ways become mechanically nonfunctional so as to require more drastic operations to remove the packer, such as milling.

One of the objects of this invention is to make it possible for operators to position and secure a downhole tool so that operations which generate high loadings could immediately take place without fear of premature shear release. Furthermore, to further the objectives of the invention, the short-term advantages of being able to withstand high shear loadings could be provided in the invention, while at the same time the long-term disadvantages due to environmental attack could then be eliminated by enabling a shear-release mechanism long before any of the environmental conditions could disable the moving sleeve release mechanism or an equivalent which had been relied on during the perforating or acidizing or other formation treatment operations.

SUMMARY OF THE INVENTION

A system for releasing a downhole tool such as a packer is revealed which allows the tool to retain its set position against a very high loading force which can occur during operations such as perforating or acidizing or other formation treatments. Subsequently, before environmental conditions can adversely affect the integrity of the locking mechanism which employs a movable sleeve or equivalent, the release mechanism involving such a sleeve or equivalent is actuated. This disables one of the locking mechanisms on the tool and enables a shear-release mechanism, which is preferably set at a fairly low shear force to facilitate simple removal of the downhole tool at a later time when it becomes necessary to retrieve it.

DETAILED DESCRIPTION OF THE PREFERRED EMBODIMENT

Figure 1A:
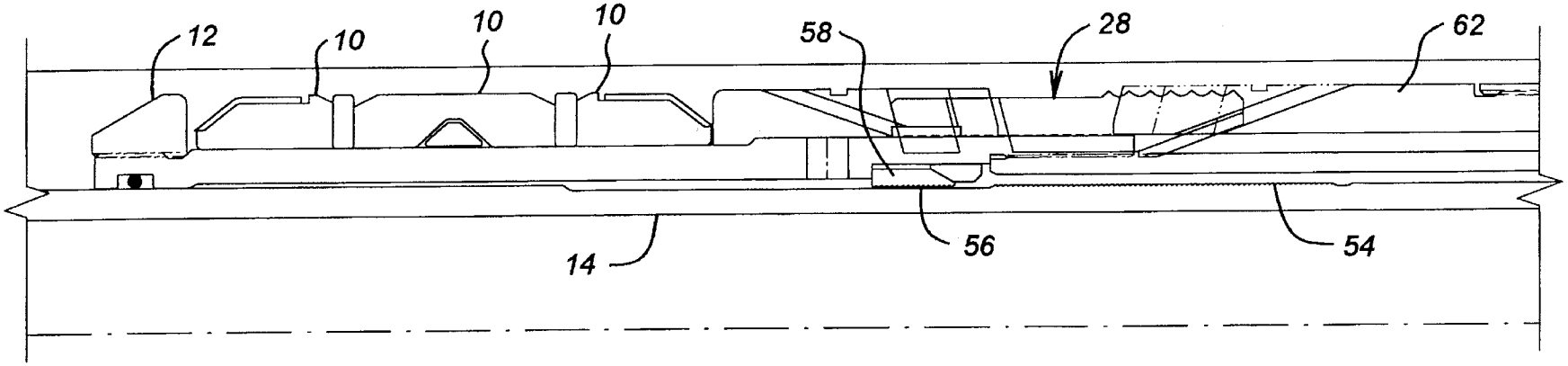
FIGS. 1*a*–1*c* illustrates the apparatus of the present invention in the run-in position in a sectional elevational view.
Figure 1B:
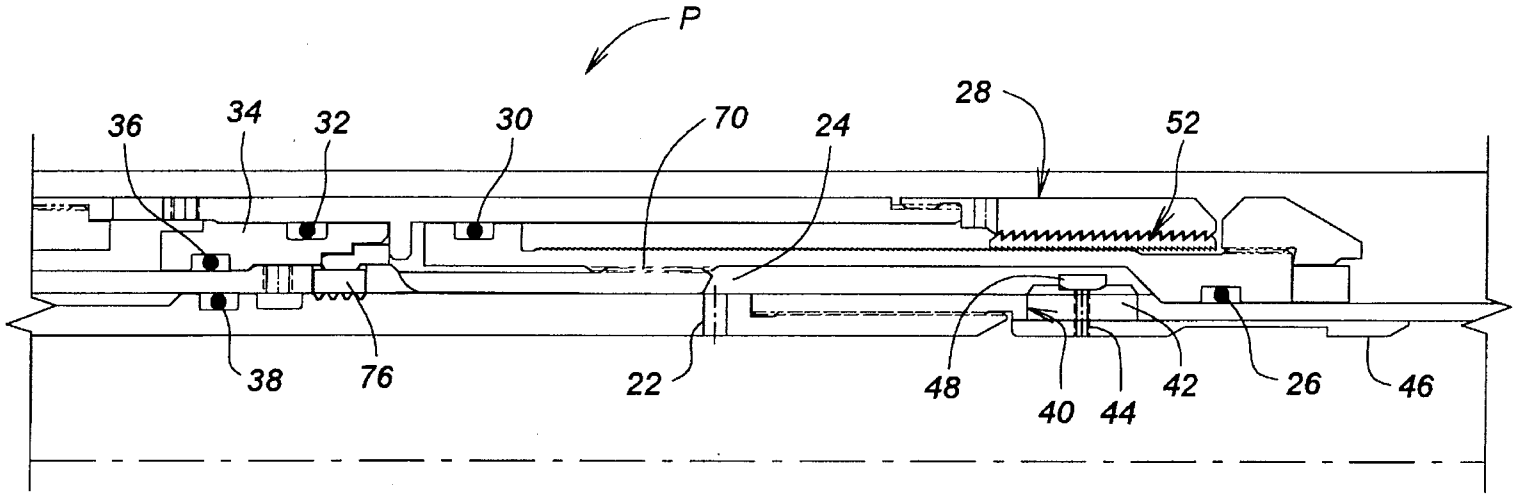
Figure 1C:
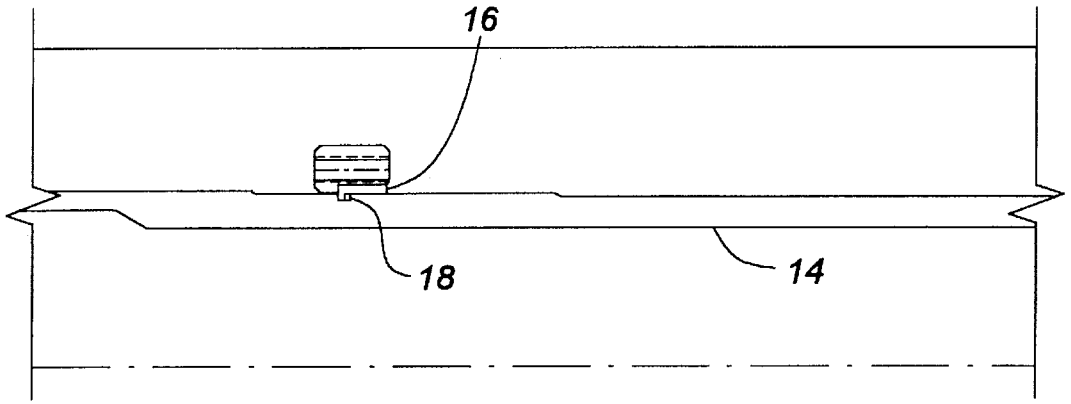

FIG. 1*a*–*c* shows a downhole tool which, in this case, is a packer P. In many ways, the construction of the packer P is of a design known in the art and will only be briefly reviewed here. The packer P has a series of sealing elements 10 which are ultimately compressed by a ring 12, as seen by comparing FIG. 2*a* to FIG. 1*a*. An inner mandrel 14, which may be in one or more pieces, supports a shear-release ring or an equivalent frangible, shearable, or displaceable element or elements 16 (see FIG. 1*c*). The ring 16 is engaged to a groove 18 on mandrel 14. When engaged by the inner sleeve assembly 20 as shown in FIG. 3*c*, the shear-release ring 16 is breached from its mounting to mandrel 14 and no longer supports the inner sleeve assembly 20. This effect is seen by comparing FIG. 3*c* to FIG. 4*c*. Ring 16 can be whole or in parts and constitutes a shear-release assembly, which can be any component that loses its grip on another responsive to an applied shear force above a predetermined amount or range of amounts.

The inner sleeve assembly 20 is hydraulically actuated from the surface to move with respect to inner mandrel 14 by pressure applied into inner mandrel 14, which in turn communicates through port 22. Port 22 is in fluid communication with cavity 24. Cavity 24 is scaled against mandrel 14 by seal 26. It is also sealed against outer sleeve assembly 28 by seals 30 and 32. Taken together, the inner sleeve assembly 20 and outer sleeve assembly 28 and the components they actuate comprise a gripping member assembly, which secures and seals the packer P against the casing 64. Piston 34 supports seal 32 as well as seal 36, which seals piston 34 against inner sleeve assembly 20. Finally, seal 38 seals between mandrel 14 and inner sleeve assembly 20, thus completing all the sealing arrangements to ensure that pressure applied through port 22 into cavity 24 exerts a downward force on inner sleeve assembly 20, which results in its movement toward shear-release ring 16, as illustrated by comparing FIGS. 1*b* and 2*b*.

The mandrel 14 has a window 40 through which extends lug or lugs 42. Each lug 42 is secured by a shear pin 44 to a sliding sleeve 46. The collection of lugs 42 is further secured by a snap ring or band spring or equivalent 48. Each lug 42 extends through window 40 into cavity 24, where it acts as a travel stop or lock for inner sleeve assembly 20. Thus, in the position shown in FIGS. 2*b* and *c*, with the lug 42 extending into cavity 24, and fully supported in that position by the positioning of sleeve 46, surface 50 on inner sleeve assembly 20 further prevents downward movement of inner sleeve assembly 20 before it can reach the shear-release ring 16 when in the locked position shown.

To now complete the actuation sequence to place the packer P in the set position shown in FIG. 2, the application of pressure to cavity 24 shifts the inner sleeve assembly 20 downwardly with respect to the outer sleeve assembly 28 after piston 34 moves upwardly.

Those skilled in the art will appreciate that the piston 34 keeps the locking segments 76 trapped against mandrel 14, thus ensuring that piston 34 moves upwardly to urge slip 60 against casing 64 for an initial bite, whereupon locking dogs 76 are liberated. This allows the inner sleeve assembly 20 to move downwardly in response to pressure in cavity 24 to compress the sealing elements 10 and lock the set position shown in FIG. 2 through the use of body lock rings 52 and teeth 54 in combination with wedge 58.

Once the shifting of inner sleeve assembly 20 has occurred, the position is locked by a body lock ring 52. Body lock ring 52 helps to retain the position in FIG. 2*b* following movement of inner sleeve assembly 20. Similarly, mandrel 14 has ratchet teeth 54 which ultimately engaged by teeth 56 on wedge 58. This also secures the set position shown in FIG. 2*a*. In the set position, the slips 60 are ramped outwardly on cone 62 until they engage the casing 64. At the same time, the packing elements 10 are compressed by ring 12 to effectuate the seal against the casing 64 or equivalent in the wellbore.

Figure 2A:
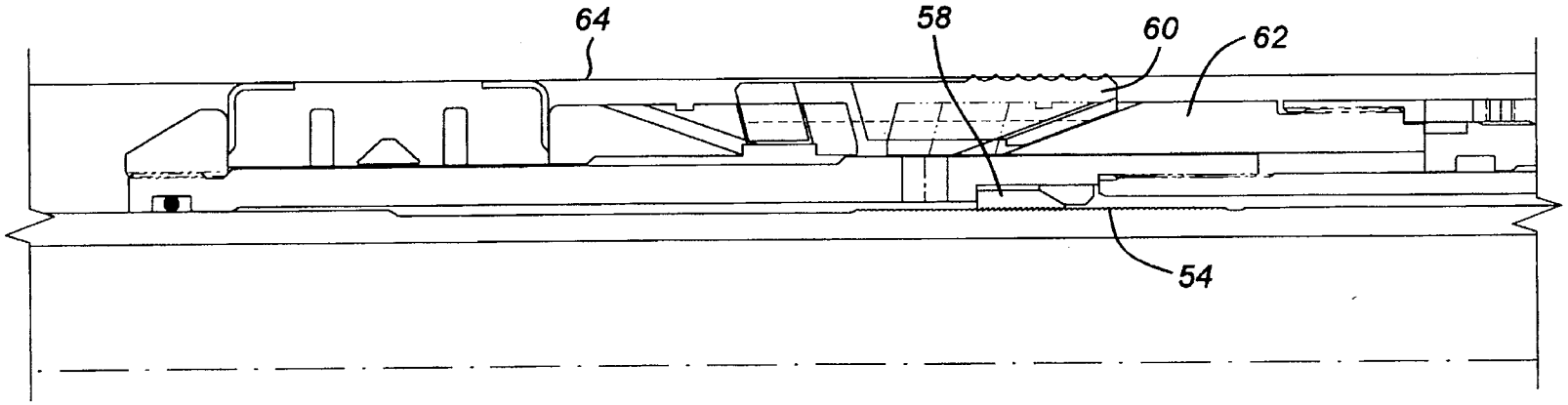
FIGS. 2*a*–2*c* is the view of FIG. 1 in the set position.
Figure 2B:
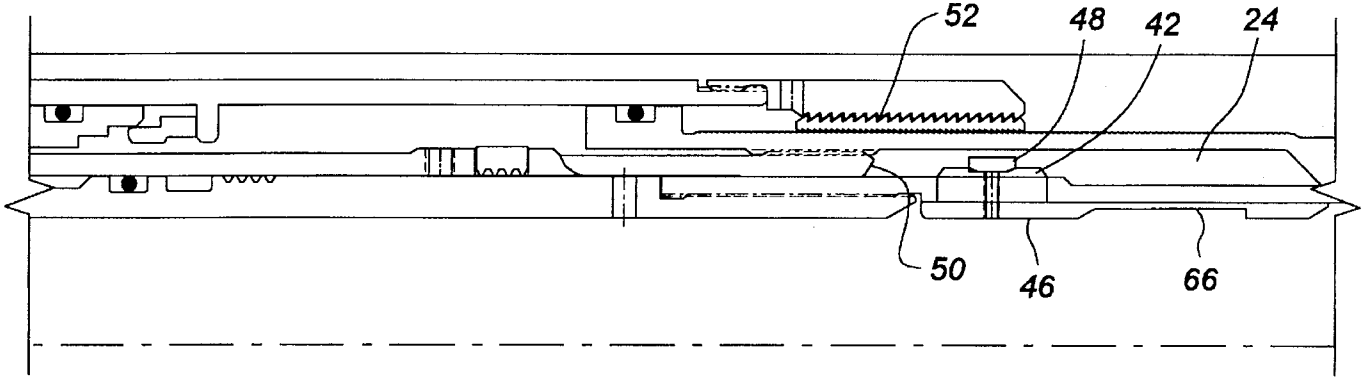
Figure 2C:
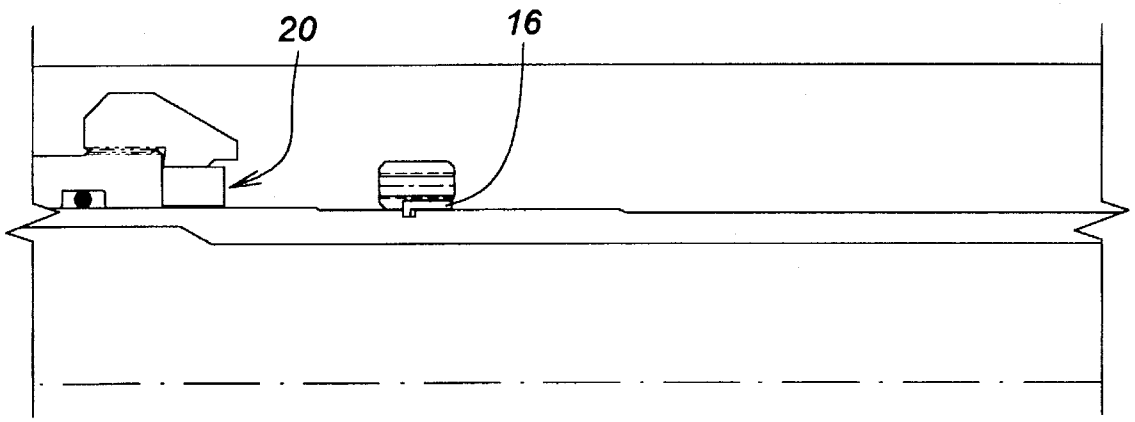
Figure 3A:
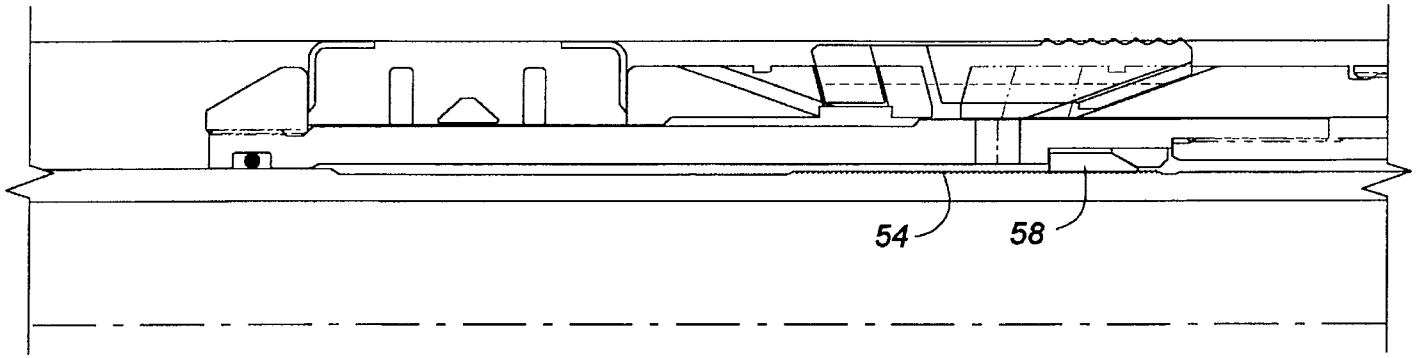
FIGS. 3*a*–3*c* is the view of FIG. 2, with the shifting-release mechanism actuated and the shear-release mechanism energized.

It can be seen that the packer P is in the fully set position in FIGS. 2*a–c*, with the lugs 42 extending into cavity 24, effectively locking out or isolating the shear-release mechanism 16 from being engaged. In this position, tubing-conveyed perforating guns can be shot or other acidizing or formation treatment can occur which can generate very high shear forces which can be easily withstood through inner sleeve assembly 20 acting on the lugs 42 when fully supported by sleeve 46.

Figure 3B:
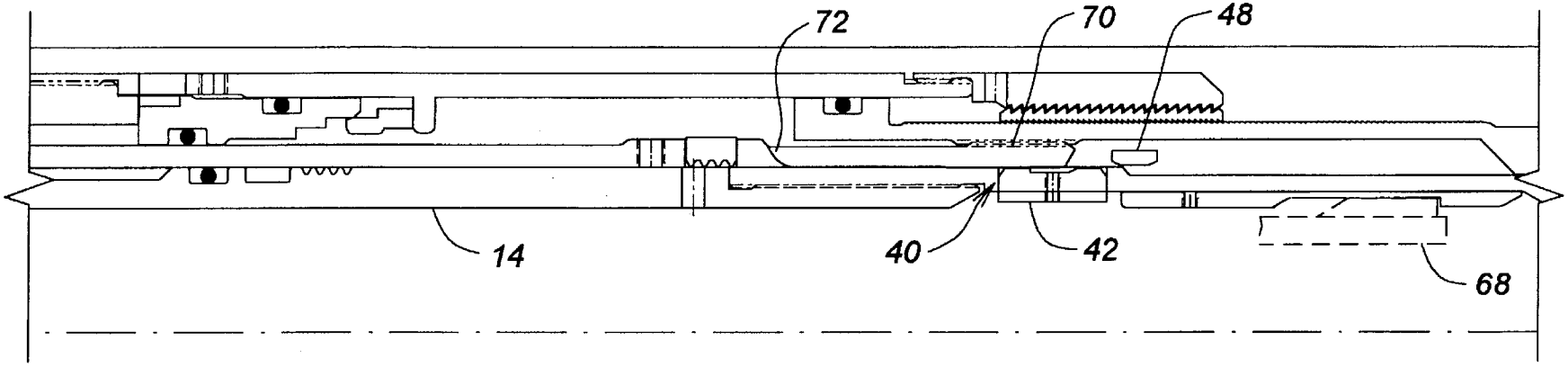
Figure 3C:
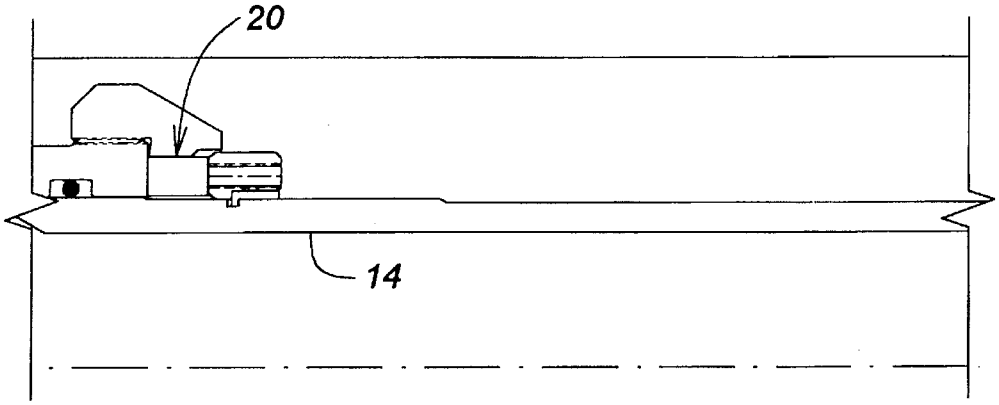

After the completion of the downhole operations which generally are done a short time after placement of the packer P and securing it into position, a shifting tool of a known design can be lowered into the wellbore, preferably by wireline or by other equivalent means to engage the groove 66 on sleeve 46 and to move the sleeve 46 from the position shown in FIG. 2*b* to the position shown in FIG. 3*b*. The shifting tool 68 is shown schematically in FIG. 3*b*. Once the shifting tool 68 has shifted sleeve 46 away from lugs 42, the snap ring 48 or an equivalent mechanism, such as a band spring, biases the lugs 42 inwardly toward mandrel 14 such that the lugs 42 retract to be fully within the window 40, as shown in FIG. 3*b*. The shear-release ring 16 is now exposed, since the locking effect of lugs 42 is eliminated, and ring 16 may be broken or displaced by movement of mandrel 14. Thereafter, upward movement of mandrel 14, breaking or displacing ring 16, as seen by comparing FIGS. 3*a–c* to 4*a–c*, is possible which results in mating threads 70 becoming undermined as an upward pull on mandrel 14 displaces the snap ring 48, which in turn allows segment 72 of inner sleeve assembly 20 to flex toward mandrel 14 and effectively become disengaged, taking with it one portion of thread 70 while leaving the other behind. At the same time, wedge 58, which had previously been engaged to teeth 54, rides completely off teeth 54 and onto a smooth surface 74. As a result of the upward movement of mandrel 14, the slips 60 are pulled back along cone 62 and retracted away from casing or equivalent 64. At that point, although not shown in FIG. 4*a*, the sealing elements 10 may relax.

Figure 4A:
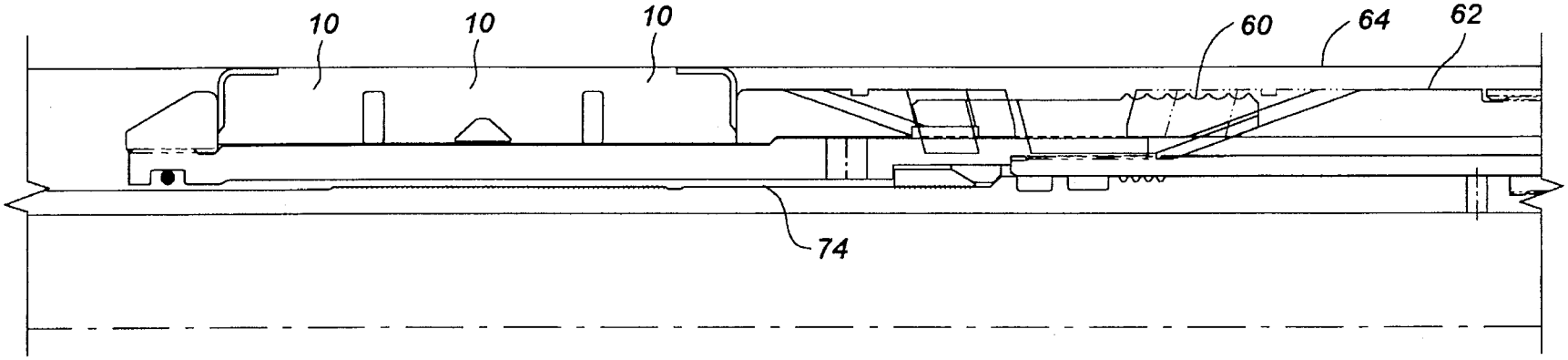
FIGS. 4*a*–4*c* is the view of FIG. 3, with the shear-release mechanism sheared and the apparatus released from its grip so that it may be retrieved.
Figure 4B:
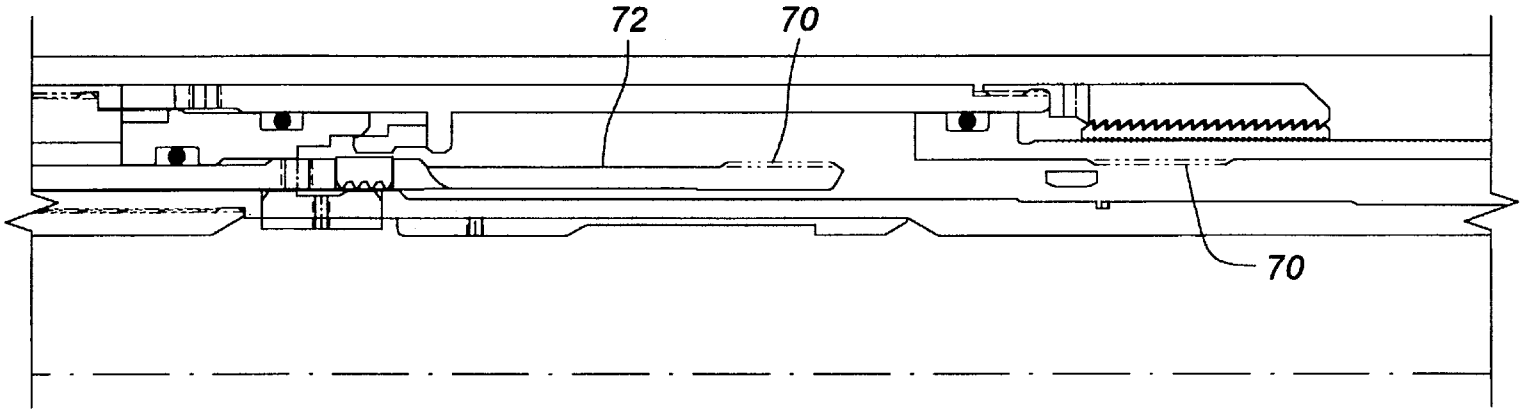
Figure 4C:
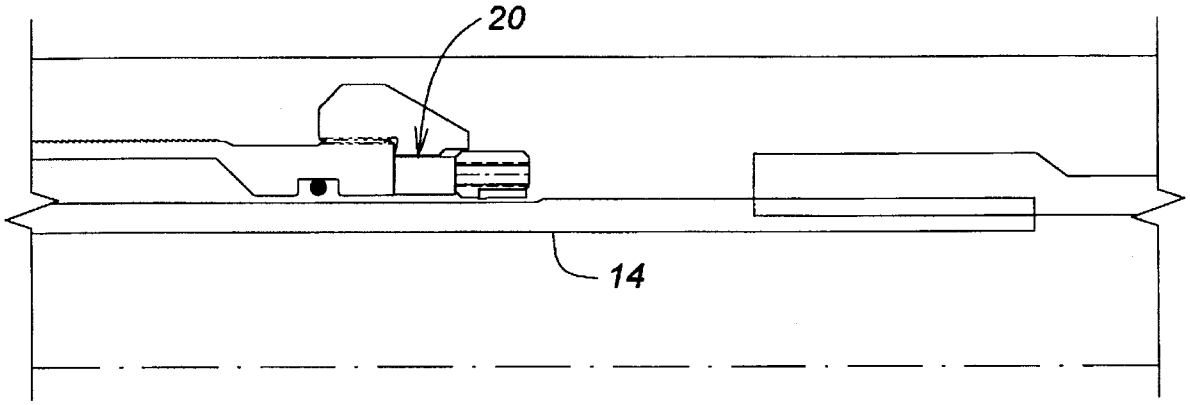

The retraction of the lugs 42 and subsequent displacement of the snap ring 48, coupled with an upward pull on mandrel 14, brings the shear-release ring 16 in contact with inner sleeve assembly 20 which, upon exceeding a predetermined force, shears off the connection to the mandrel 14 by the shear-release ring 16 at groove 18 to enable further movement, as illustrated in FIG. 4*a–c*, for ultimate release of the slips 60 and sealing elements 10.

Those skilled in the art will readily appreciate that what has been illustrated in the figures is a packer or other downhole tool which can withstand significant shearing forces during such procedures as perforating, acidizing, or similar formation treatment operations, without any risk of premature or accidental release. Furthermore, in wells that tend to produce paraffins or other materials that may adversely affect the operation of a lock mechanism, such as embodied by the lugs 42 extending through a window 40 while supported by a shifting sleeve 46, with a release mechanism which is initially defeated and becomes enabled when the lock mechanism is deliberately defeated. What this means in the embodiment illustrated in FIGS. 1–4 is that the shifting sleeve lock mechanism, encompassed by the lugs 42 extending through window 40 and supported by sliding sleeve 66, provides the comfort to the operator that accident release will not occur. At the same time, the hazards of the assembly, which includes the lugs 42 and sleeve 66, freezing up or for other reasons not functioning when needed at a much later time after the downhole operations are concluded, is removed. The reason for this is that after the conclusion of the perforation or other downhole operations and bringing the well into production, which could adversely affect the subsequent operation of the sleeves 66 and lugs 42, the mechanism of lugs 42 is fully defeated while it is still reliably functional. At this time there is yet no release of the packer P.

Thereafter, due to the defeat of the lock-out feature of lugs 42 extending through window 40, the shear-release ring 16 is fully activated. The release force can be set at a relatively low value, such as 20,000–30,000 lbs. of force, to facilitate the ultimate removal of the packer P at a much later time. Since the shear-release ring 16 is disabled from operation until the sleeve 66 is shifted, the release value of shear-release ring 16 can be set at a very low value with confidence that accidental releases will not occur. On the other side of the coin, the design of lugs 42 with sleeve 66 can be such that shear forces of very high values, about 100,000 lbs. or more, can be anticipated and dealt with without any unintended release of the packer P.

While what has been illustrated is a scheme of lugs 42 extending through a window 40, backed up by a sleeve 66, as the primary lock and load-absorbing device, and the shear-ring 16 as the release which comes into effect after disabling the lugs 42, other mechanisms for bearing the initial forces generated by perforating and other downhole treatments, can be employed without departing from the spirit of the invention. Thus, many different types of locks which prevent the functioning of a frangible, shearable, or displaceable release mechanism, which are different in structure and construction from lugs 42 extending through windows 40, supported or unsupported by a shifting sleeve 66, can also be employed without departing from the spirit of the invention. Included in the scope of the invention is any locking mechanism which, for a predetermined duration, isolates a frangible or shearable release mechanism which subsequently becomes operational upon the defeat of the lock mechanism. It is also within the scope of the invention that the lock mechanism employed to isolate initially a subsequent release mechanism need not be the component that actually takes the load from the perforating gun or other equipment during the downhole operations. For example, the initial loads created by, for example, shooting a perforating gun can be absorbed by other mechanisms within the packer P, but the lock mechanism may function separately or independently, preventing the necessary movements which would engender a release of the packer. Stated differently, the locking mechanism may not necessarily have to be load-bearing, fully or even in part, so long as it functions to prevent unintended release of the packer P during operations such as perforating, acidizing, or related formation treatment operations by breakage or displacement of the frangible or shearable member 16. Similarly, the ultimate release mechanism, while shown as a shear ring 16, can also be many other types of release structures without departing from the spirit of the invention, such as a ceramic ring or any member that breaks, dissolves, or otherwise disintegrates. Those skilled in the art will appreciate that the preferred embodiment of the invention is illustrated in FIGS. 1–4.

The invention offers the advantage of having release mechanisms which can withstand large disparate differences in load to accommodate initial operations where high loads are encountered and to subsequently accommodate intentional release of the packer P where low loads are desirable to initiate the desired release. That advantage, coupled with selective operation or functionality of the ultimate release mechanism, allows in a single trip the placement and setting of a packer P, followed by immediate initiation of the subsequent operation such as perforation, all with the comfort and security that premature release due to the high loads of such operations will not occur and further in hostile environments that the ultimate release mechanism will function when ultimately required.

The foregoing disclosure and description of the invention are illustrative and explanatory thereof, and various changes in the size, shape and materials, as well as in the details of the illustrated construction, may be made without departing from the spirit of the invention.

What is claimed is:

1. A release apparatus in combination with a downhole tool, comprising:

a tool body;

a gripping member assembly to selectively secure said body in the wellbore;

a release member on said body, selectively actuable, and when enabled for actuation to allow release of said gripping assembly from the wellbore responsive to an applied force beyond a predetermined amount;

a lock assembly on said body, selectively operable between a locked position, where said release member is not enabled for actuation, to an unlocked position, wherein said release member is enabled for actuation for release of said gripping assembly from the wellbore.

2. The release apparatus of claim 1, wherein:

said release member is responsive to a shear force.

3. The release apparatus of claim 2, wherein:

said release member shears apart in response to a shear force.

4. The release apparatus of claim 2, wherein:

said release member frangibly breaks responsive to a shear force.

5. The release apparatus of claim 2, wherein:

said lock assembly in said locked position prevents transmission to said release member of said shear force applied to said gripping member.

6. The release apparatus of claim 5, wherein:

said lock assembly in said locked position limits movement of said gripping member assembly with respect to said body to a position short of contact with said release member, thus preventing said gripping member assembly from imposing a shear force on said release member.

7. The release apparatus of claim 6, wherein said lock assembly further comprises:

at least one dog selectively extending through said body;

a movable member on said body selectively movable from a first position, wherein said dog is in an extended position to act as a travel stop, preventing application of a shear force on said release member, to a second position, where said dog may retract to allow application of a shear force on said release member by relative movement between said gripping member and said body.

8. The release apparatus of claim 7, wherein:

said release member is capable of supporting a loading imposed by said gripping member of up to about 20,000–30,000 lbs. before release;

said dog, with said movable sleeve in said first position, is capable of supporting shear forces imposed by said gripping member assembly on said body of over 100,000 lbs., while at the same time preventing sufficient movement of said gripping member assembly from contracting said release member unless said movable sleeve is placed in said second position.

9. The release apparatus of claim 8, wherein:

said body has a groove thereon;

said release member comprises a shear ring, a part of which extends into said groove and breaks off said shear ring upon application of a predetermined load, applied to said shear ring by said gripping member assembly.

10. A method of using a downhole tool to perform operations which generate stresses on portions thereof, comprising the steps of:

running the tool into position in the wellbore;

setting the tool in the wellbore in a configuration where it cannot be shear-released;

performing downhole operations that cause stresses in the tool to a level in excess of the release limit of the shear-release mechanism in the tool, while the shear-release mechanism in the tool is disabled from causing a release;

concluding said downhole operations;

enabling said shear-release mechanism to operate at the conclusion of said downhole operations to release in response to an applied load.

11. The method of claim 10, further comprising the step of:

using a selectively retractable dog to prevent movement in the tool responsive to an applied force from stressing said shear-release mechanism.

12. The method of claim 11, further comprising the steps of:

providing a shiftable member to selectively support said dog;

shifting said shiftable member with a shifting tool lowered into the well from the surface.

13. The method of claim 12, further comprising the step of:

using a shear ring as the shear-release mechanism which is actuable at a lower stress than the stress imposed on the tool during said performing downhole operations step.

14. A method of performing a downhole operation, comprising the steps of:

running in a tool configured for a shear-release and having a lock-out mechanism for the shear-release set to prevent release in response to applied loads;

setting the tool in the wellbore;

performing downhole operations which apply stress to the tool without a release due to said shear-release being defeated by said lock-out mechanism;

moving said lock-out mechanism;

enabling said shear-release by said moving of said lock-out mechanism;

applying a predetermined force to the tool;

actuating said shear-release by said applied force;

unsetting said tool due to said actuating said shear-release;

removing said tool from the wellbore.

15. The method of claim 14, further comprising the steps of:

configuring said tool as a downhole packer;

providing a movable gripping mechanism to set at least one slip and to compress at least one sealing element.

16. The method of claim 15, further comprising the steps of:

blocking the path of said movable gripping mechanism with at least one dog;

selectively supporting said dog to allow it to either block or move out of the path of said movable mechanism.

17. The method of claim 16, further comprising the steps of:

using a sliding sleeve for selective support of said dog;

shifting said sleeve from the surface;

allowing said movable mechanism to contact said shear-release due to retracting of said dog.

18. The method of claim 17, further comprising the step of:

providing a bias on said dog to facilitate its retraction when said sleeve is shifted from the surface.

19. The method of claim 15, further comprising the steps of:

providing a shear ring on a mandrel of said packer as said shear-release;

loading said shear ring with said movable gripping mechanism resulting from relative movement therebetween made possible by prior movement of said lock-out mechanism to enable said shear-release.

20. The method of claim 18, further comprising the steps of:

providing a shear ring on a mandrel of said packer as said shear-release;

loading said shear ring with said movable gripping mechanism resulting from relative movement therebetween made possible by prior movement of said lock-out mechanism to enable said shear-release.

* * * * *